US010518128B2

(12) United States Patent
Liu

(10) Patent No.: US 10,518,128 B2
(45) Date of Patent: Dec. 31, 2019

(54) ELLIPTICAL TRAINER

(71) Applicant: Dyaco International Inc., Taipei (TW)

(72) Inventor: Shih-Wei Liu, Taipei (TW)

(73) Assignee: Dyaco International Inc., Taipei (TW)

( * ) Notice: Subject to any disclaimer, the term of this patent is extended or adjusted under 35 U.S.C. 154(b) by 156 days.

(21) Appl. No.: 15/824,951

(22) Filed: Nov. 28, 2017

(65) Prior Publication Data

US 2019/0118033 A1 Apr. 25, 2019

(30) Foreign Application Priority Data

Oct. 20, 2017 (TW) ..... 106136209 A

(51) Int. Cl.
*A63B 22/06* (2006.01)
*A63B 21/22* (2006.01)
*A63B 22/00* (2006.01)

(52) U.S. Cl.
CPC ..... *A63B 22/0664* (2013.01); *A63B 21/225* (2013.01); *A63B 22/001* (2013.01); *A63B 2022/0682* (2013.01)

(58) Field of Classification Search
CPC ..... A63B 21/00058; A63B 21/00069; A63B 21/00072; A63B 21/00076; A63B 21/00178; A63B 21/00181; A63B 21/00185; A63B 21/00192; A63B 21/005; A63B 21/0051; A63B 21/0052; A63B 21/0056; A63B 21/012; A63B 21/0125; A63B 21/015; A63B 21/018; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/15; A63B 21/151; A63B 21/152;
(Continued)

(56) References Cited

U.S. PATENT DOCUMENTS 6,045,487 A 4/2000 Miller
9,061,175 B1 * 6/2015 Miller ..... A63B 22/0664
(Continued)

FOREIGN PATENT DOCUMENTS

TW M558098 4/2018

OTHER PUBLICATIONS

Office Action dated Jun. 6, 2018 in corresponding Taiwan Patent Application No. 106136209.

*Primary Examiner* — Gary D Urbiel Goldner
(74) *Attorney, Agent, or Firm* — Donald E. Stout; Stout, Uxa & Buyan, LLP

(57) ABSTRACT

An elliptical trainer is provided with a frame, a resistance device, two cranks, two guide link assemblies, and two flexible members. The frame includes a first pivot. The resistance device provides a resistance and includes a wheel with an axis. The two cranks are arranged at a left and a right side of the wheel, respectively, and each crank has a first end coupling with the axis. The two guide link assemblies are arranged at a left and a right side of the frame, respectively, and each guide link assembly has a front end pivotally coupling with the first pivot and a second end coupling with a pedal. In addition, each crank has a second end coupling with a corresponding guide link assembly, and each flexible member has a first end indirectly pivoted to the first pivot and a second end coupled to a corresponding guide link assembly.

9 Claims, 5 Drawing Sheets

(58) Field of Classification Search
CPC ..... A63B 21/154; A63B 21/159; A63B 21/22; A63B 21/225; A63B 21/4027; A63B 21/4033; A63B 21/4034; A63B 21/4035; A63B 21/4045; A63B 21/4047; A63B 21/4049; A63B 22/001; A63B 22/0015; A63B 22/0017; A63B 22/0046; A63B 22/0048; A63B 22/06; A63B 22/0664; A63B 22/0694; A63B 2022/0051; A63B 2022/0053; A63B 2022/0676; A63B 2022/0682; A63B 23/035; A63B 23/03516; A63B 23/03533; A63B 23/03541; A63B 23/0355; A63B 23/03575; A63B 23/03591; A63B 23/04; A63B 23/0405; A63B 23/0417; A63B 23/0423; A63B 23/0482; A63B 23/0494; A63B 23/12; A63B 23/1209; A63B 23/1245; A63B 23/1263; A63B 23/1281; A63B 69/0028; A63B 69/18; A63B 69/185; A63B 2208/0204; A63B 2225/09; A63B 2225/093
See application file for complete search history.

(56) References Cited

U.S. PATENT DOCUMENTS 9,192,809 B1 * 11/2015 Miller ..... A63B 21/154
9,511,253 B1 * 12/2016 Miller ..... A63B 22/001
9,827,461 B1 * 11/2017 Miller ..... A63B 22/0664
9,901,774 B2 * 2/2018 Miller ..... A63B 21/156
9,907,995 B1 * 3/2018 Miller ..... A63B 22/0605
2007/0037667 A1 * 2/2007 Gordon ..... A63B 21/155 482/51
2008/0161163 A1 * 7/2008 Stewart ..... A63B 21/0051 482/51
2008/0161164 A1 * 7/2008 Stewart ..... A63B 22/001 482/52
2013/0210578 A1 * 8/2013 Birrell ..... A63B 71/0622 482/4
2014/0051552 A1 * 2/2014 Habing ..... A63B 21/154 482/52
2014/0336006 A1 * 11/2014 Miller ..... A63B 21/154 482/52
2014/0336007 A1 * 11/2014 Miller ..... A63B 22/04 482/52
2015/0335943 A1 * 11/2015 Miller ..... A63B 22/0664 482/52
2015/0335944 A1 * 11/2015 Miller ..... A63B 22/0664 482/52
2016/0059067 A1 * 3/2016 Miller ..... A63B 21/154 482/52
2016/0151663 A1 * 6/2016 Miller ..... A63B 22/0664 482/52
2016/0151664 A1 * 6/2016 Miller ..... A63B 22/0664 482/52
2016/0151665 A1 * 6/2016 Miller ..... A63B 21/4049 482/52
2018/0304115 A1 * 10/2018 Miller ..... A63B 22/001

* cited by examiner

ELLIPTICAL TRAINER

CROSS-REFERENCE TO RELATED APPLICATIONS

The entire contents of Taiwan Patent Application No. 106136209, filed on Oct. 20, 2017, from which this application claims priority, are expressly incorporated herein by reference.

BACKGROUND OF THE INVENTION

1. Field of the Invention

The present invention relates to an exercise machine, and more particularly relates to an elliptical trainer.

2. Description of Related Art

An elliptical trainer, also called a cross-trainer or an X-trainer, is a stationary exercise machine to simulate stair climbing, walking, or running.

The elliptical trainer does not cause excessive pressure to the joints as the two legs simultaneously share the burden, hence decreasing the risk of impact injuries.

Conventional elliptical trainers employ wheels moved on tracks to form a closed elliptical moving path for the pedals. For example, a U.S. Pat. No. 7,316,633 discloses an elliptical trainer that includes a pair of slide members. The front end of each slide member is connected pivotally to respective crank members for rotation along with the crank members, and rear ends of each slide member is wheeled and engaged slidingly with respective slide rails so that the rear ends are slidable linearly on the base. In addition, a swinging unit includes a pair of swinging arms and a pair of reciprocating members. The front end of each reciprocating member is pivoted to the bottom end of the corresponding swinging arm, and the rear end of each reciprocating member is fixed with a foot support. Each slide member is connected pivotally to one of the slide members. When the elliptical trainer is operated, the front ends of the slide members move along with the respective crank members along circular paths, and the rear ends of the slide members slide linearly in the respective slide rails. As a result, each foot of the user ascends and descends alternately together with the foot support members along an elliptical path.

In addition, applicant's prior U.S. Pat. No. 8,926,478 discloses an elliptical trainer that includes a base, a pair of foot-oriented elliptical mechanisms, and a pair of hand-oriented elliptical mechanisms. The base is anteriorly provided with a frame having a first axle and a second axle. The first and second first axles are parallel and spaced apart by a distance. The foot-oriented elliptical mechanisms flank the frame and include a revolving assembly pivotally disposed at the first axle and adapted to enable the foot-oriented elliptical mechanisms to revolve relative to the first axle. The hand-oriented elliptical mechanisms flank the frame and include a reversing assembly pivotally disposed at the second axle. The revolving assembly and the reversing assembly revolve in opposite directions. The hand-oriented and foot-oriented elliptical mechanisms enable a user's hands and feet to revolve in the same direction and follow closed paths, respectively.

SUMMARY OF THE INVENTION

In one general aspect, the present invention relates to an exercise machine with variable resistance.

According to an aspect of this invention, an elliptical trainer is provided with a frame, a resistance device, two cranks, two guide link assemblies, and two flexible members. The frame comprises a first pivot. The resistance device is mounted on the frame and comprises a wheel with an axis for providing a resistance. The two cranks are respectively arranged at a left side and a right side of the wheel, and a first end of each crank is coupled with the axis of the wheel. The two guide link assemblies are respectively arranged at a left side and a right side of the frame. A front end of each guide link assembly is pivoted to the first pivot and a rear end of each guide link assembly is coupled with a pedal. A second end of each crank is coupled with one corresponding guide link assembly. A front end of each flexible member is indirectly pivoted to the first pivot and a rear end of each flexible member is coupled with one corresponding guide link assembly.

In one embodiment, each flexible member comprises a plastic or leather belt or a metal rope or wire.

In one embodiment, each guide link assembly makes the connected pedal an approximately horizontal movement, the corresponded flexible member makes the pedal an approximately vertical movement, and the approximately horizontal movement combined with the approximately vertical movement leads to an elliptical or elliptical-like moving path.

In one embodiment, the front end of each flexible member connects with a first end of a joint member, and a second end of the joint member is pivoted to the first pivot.

In one embodiment, the elliptical trainer further comprises a hollow support tube fixed with the frame, wherein one or more rollers are disposed within the hollow support tube, each flexible member are guided by the one or more rollers and passes through the hollow support tube and then couples with one corresponding guide link assembly.

In one embodiment, the elliptical trainer further comprises two hand assemblies, wherein a front end of each hand assembly includes a handle to be held by an operator, and a rear end of each hand assembly couples to the joint member.

In one embodiment, each hand assembly further comprises a first linking arm and a second linking arm, and wherein a first end of the handle is held by the operator, a second end of the handle is pivoted to the second pivot, a first end of the first linking arm is pivoted to the second pivot, a second end of the first linking arm pivotally connects with a first end of the second linking arm, and a second end of the second linking arm pivotally connects to the joint member.

In one embodiment, each guide link assembly comprises an upper linking member, a crank linking member, and a foot-support member, and wherein a first end of the upper linking member is pivoted to the first pivot, a second end of the upper linking member pivotally connects with a first end of the crank linking member, a second end of the crank linking member pivotally connects with a first end of the foot-support member, a second end of the foot-support member connects with one corresponding pedal, and a second end of one corresponding crank is fixed with a portion between the first end and second end of the crank linking member.

In one embodiment, a lateral rod is disposed between the first end and second end of each foot-support member, and one corresponding flexible member couples with the lateral rod.

In one embodiment, the resistance device further comprises a pulley and a flywheel, and wherein the wheel connects with the pulley via a first connecting member, and the pulley connects with the flywheel via a second connecting flywheel.

DETAILED DESCRIPTION OF THE PREFERRED EMBODIMENT

Figure 1:
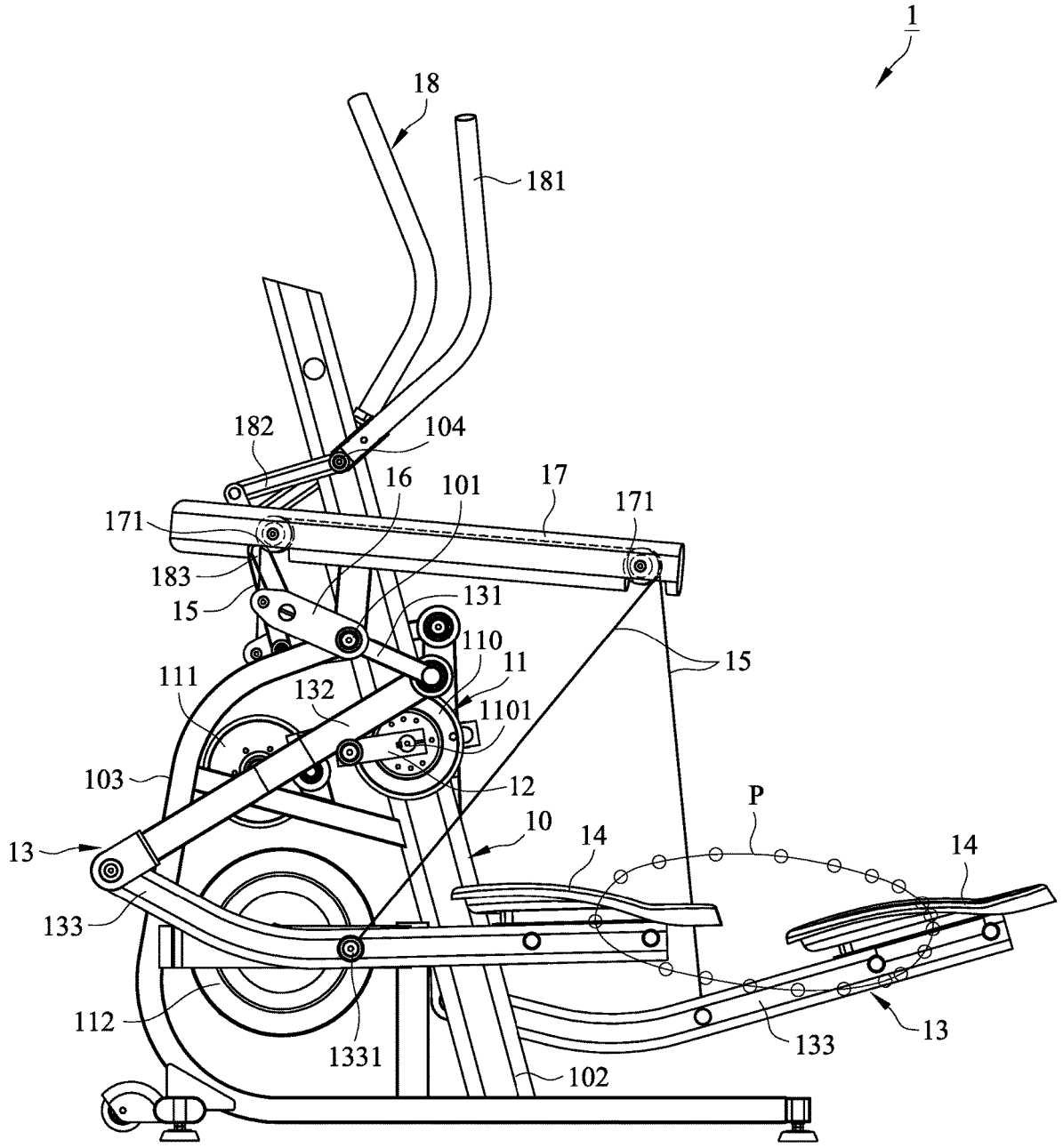
FIG. 1 is a side view showing an elliptical trainer in accordance with a preferred embodiment of the present invention.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2:
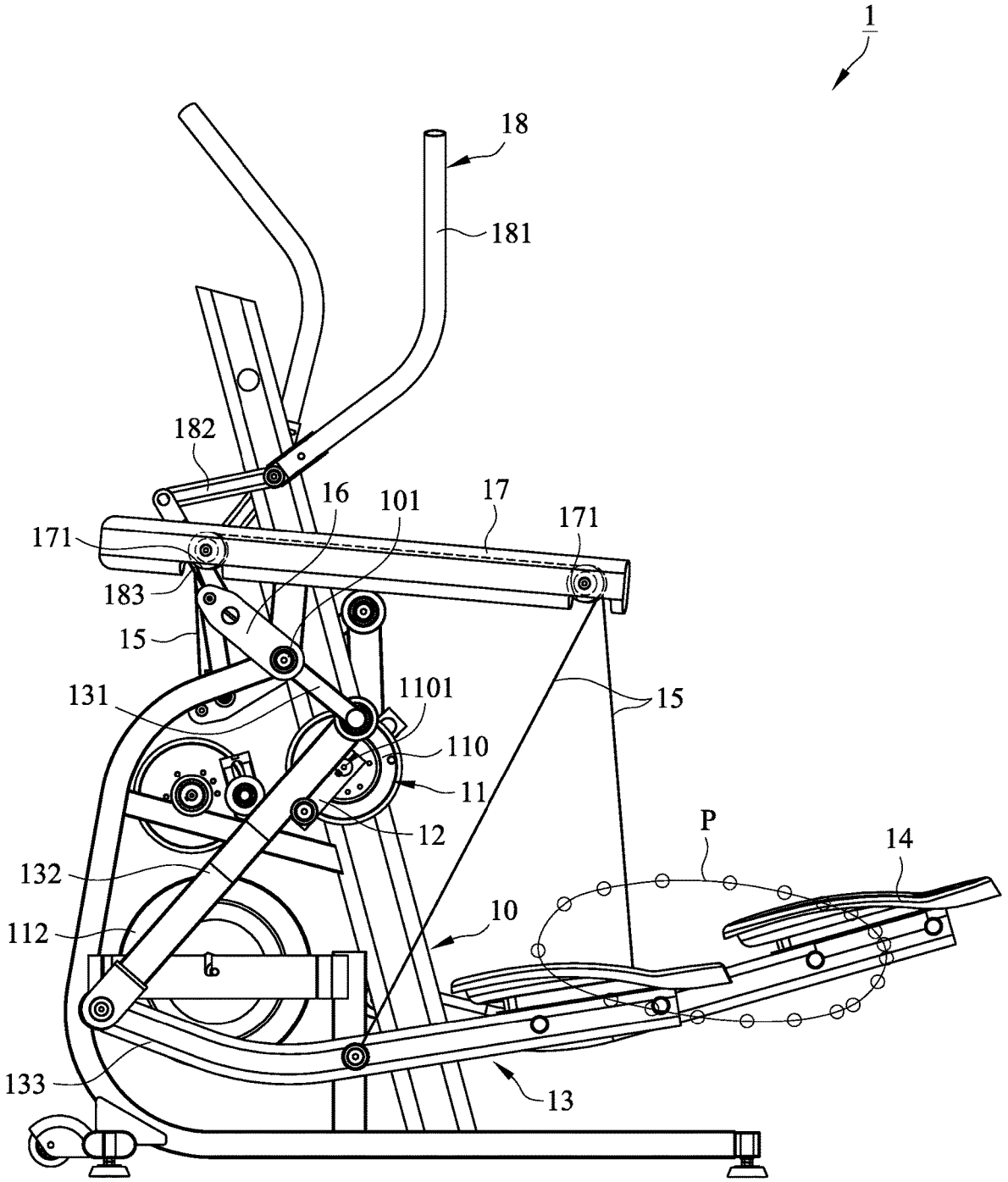
FIG. 2 is side view showing the elliptical trainer in accordance with the preferred embodiment of the present invention.
Figure 3:
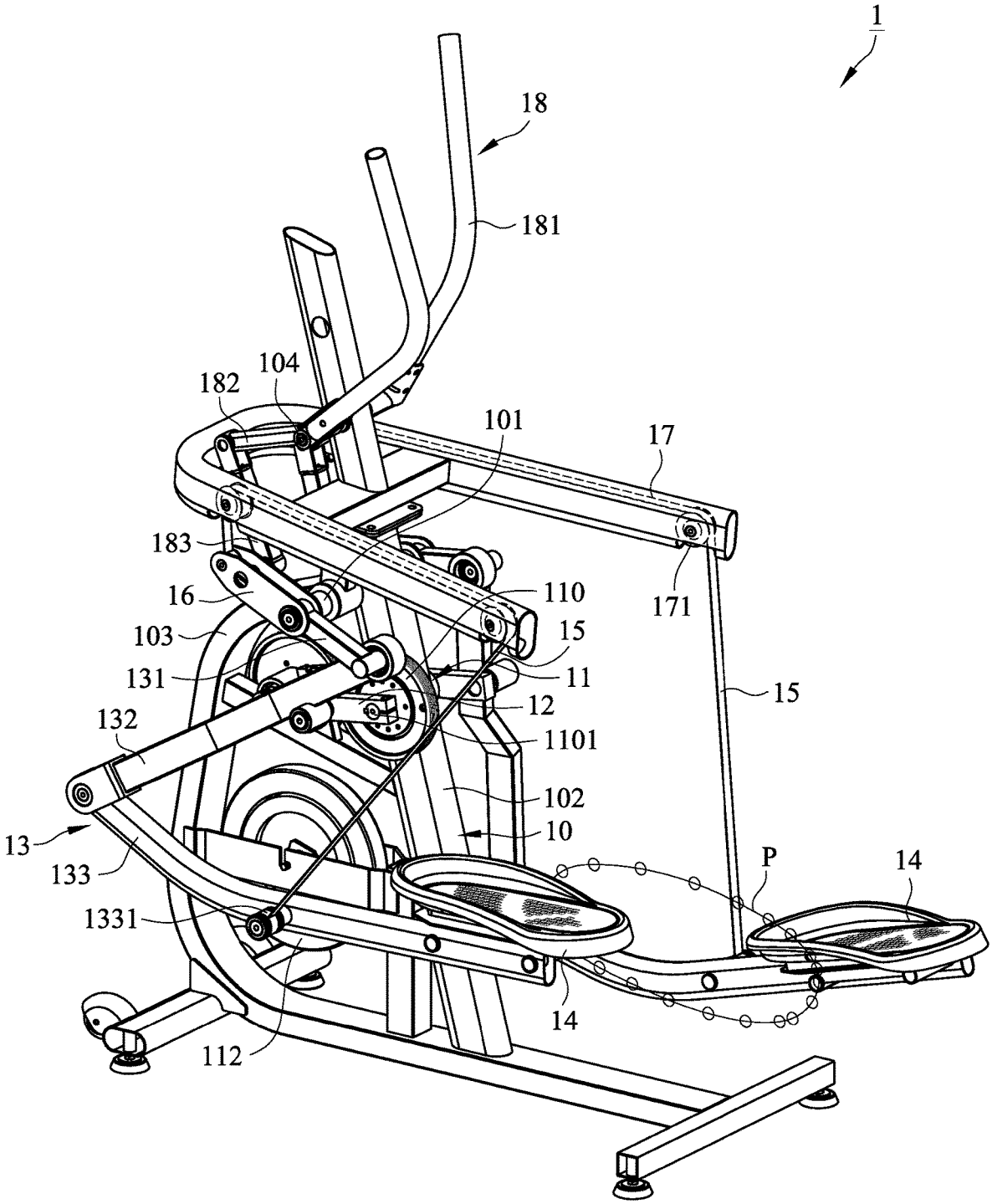
FIG. 3 is perspective view taken from an angle to show the elliptical trainer in accordance with the preferred embodiment of the present invention.
Figure 4:
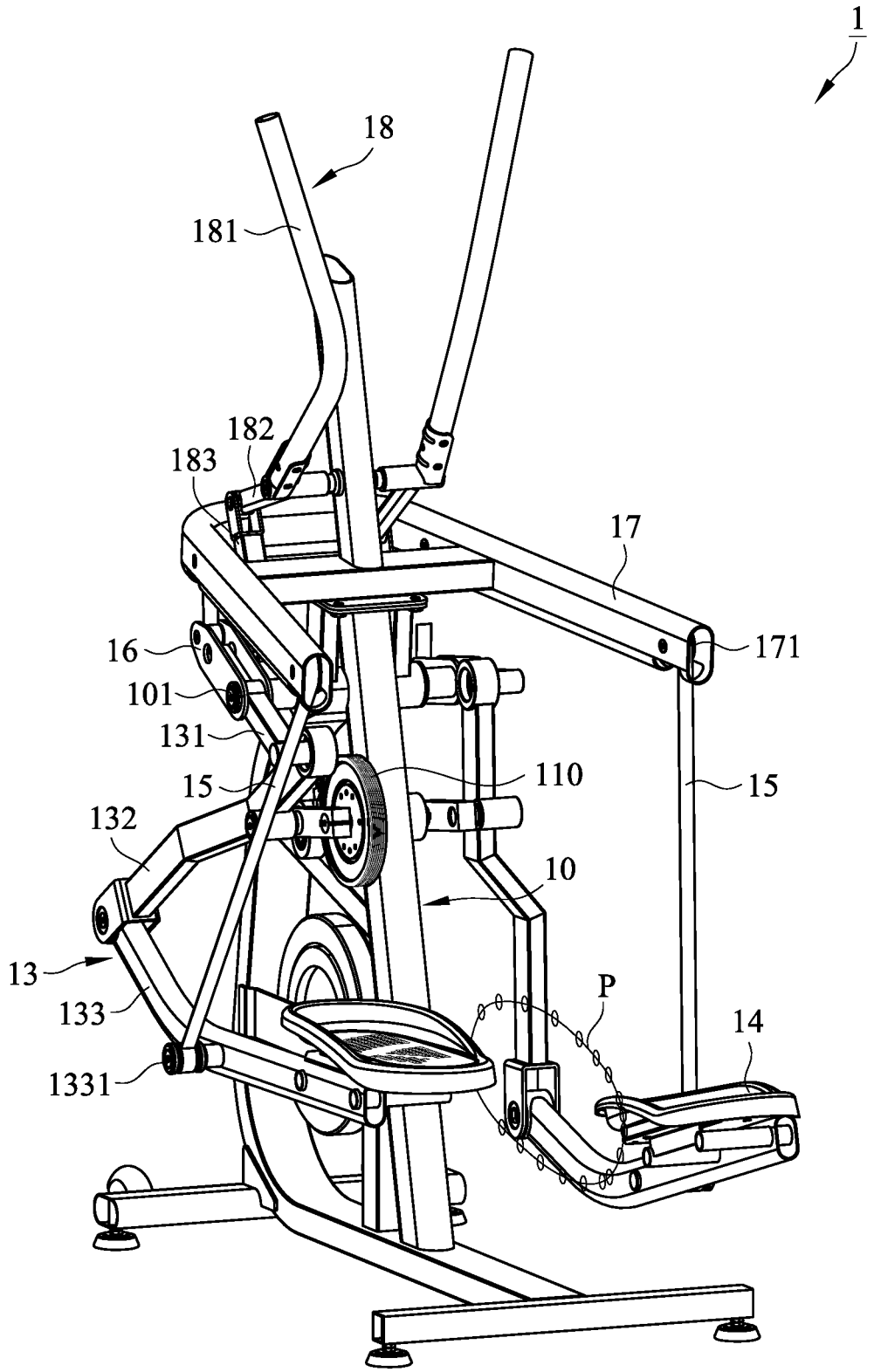
FIG. 4 is perspective view taken from another angle to show the elliptical trainer in accordance with the preferred embodiment of the present invention.
Figure 5:
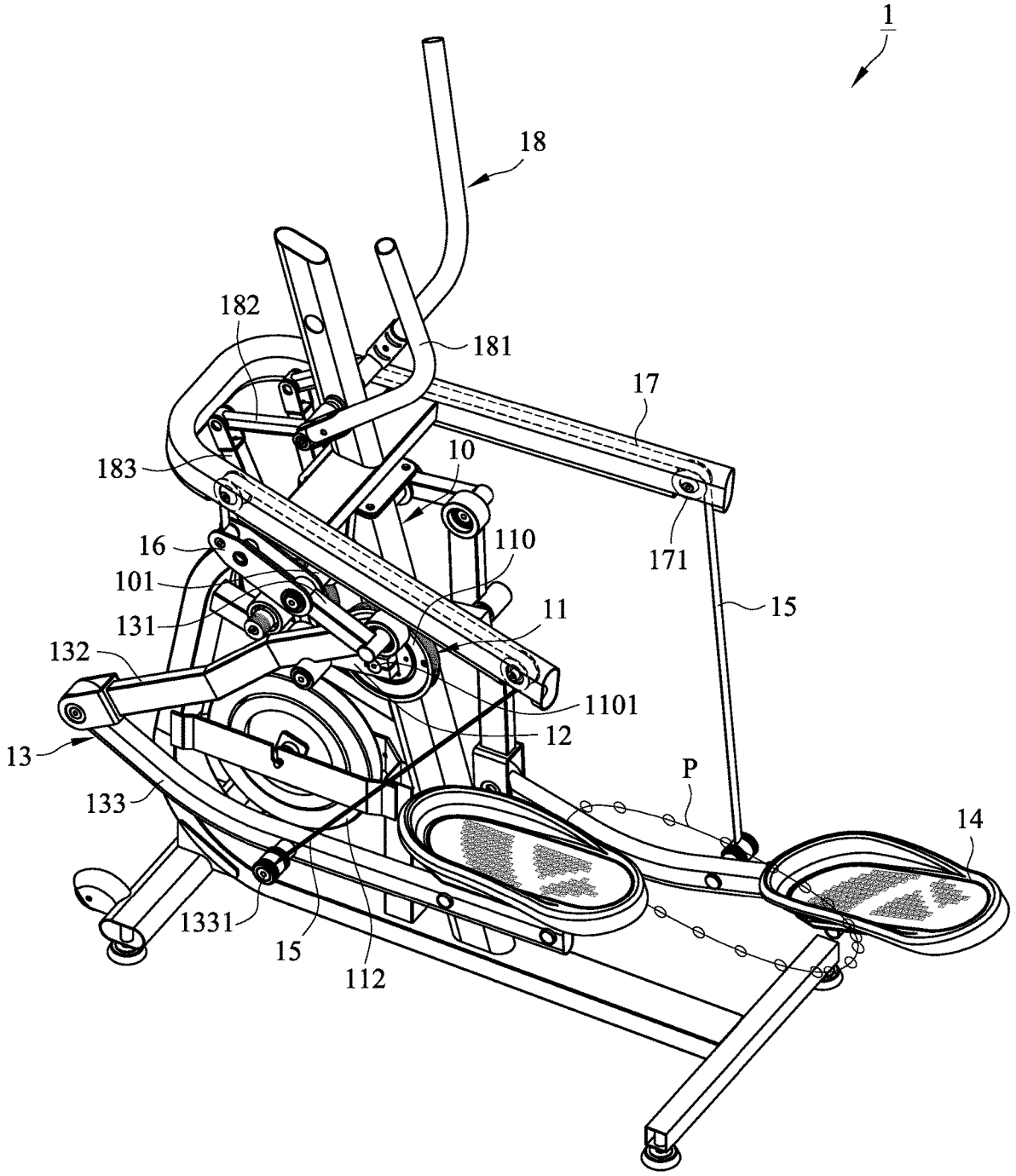
FIG. 5 is perspective view taken from another angle to show the elliptical trainer in accordance with the preferred embodiment of the present invention.

FIGS. 1 and 2 are two side views showing an elliptical trainer 1 at different operation and FIGS. 3-5 are perspective views taken from varied angles showing the elliptical trainer 1 in accordance with a preferred embodiment of the present invention. Referring to FIGS. 1-5, the elliptical trainer 1 primarily includes a frame 10, a resistance device 11, two cranks 12, two guide link assemblies 13, two pedals 14, and two flexible members 15.

Referring to FIGS. 1-5, the frame 10 includes a first pivot 101. Specifically, the frame 10 may include a post 102 and a U-shaped tube 103. A lower side of the U-shaped tube 103 contacts the ground and an upper side of the U-shaped couples the post 103. The first pivot 101 may be disposed at the junction of the post 102 and the U-shaped tube 103. In another embodiment of this invention, the frame 10 has the same first pivot 101 but may have other configurations differing from the post 102 and the U-shaped tube 103.

Referring to FIGS. 1-5, the resistance device 11 is used to provide a resistance and may include a wheel 110, which includes an axis 1101. In addition, the resistance device 11 may further include a pulley 111 and a flywheel 112. The wheel 110 connects with the pulley 111 via a first connecting member (not shown), such as a belt or a chain. The axis 1101 couples a first end of each crank 12. The pulley 111 connects with the flywheel 112 via a second connecting member (not shown), such as a belt or a chain. The movements of operator's feet drive the wheel 110 to rotate, the wheel 110 drives the pulley 111 to rotate, and then the pulley 111 drives the flywheel 112 to rotate.

Referring to FIGS. 1-5, in one embodiment the elliptical trainer 1 does not include the pulley 111, and the wheel 110 connects with the flywheel 112 via the first connecting member, such as a belt or a chain. In another embodiment the elliptical trainer 1 does not include pulley 111 and flywheel 112, and the wheel 110 is a kind of flywheel capable of providing a resistance.

Referring to FIGS. 1-5, the two cranks 12 flank the wheel 110 and respectively includes a first end coupling with the axis 1101. The two guide link assemblies 13 flank the frame 10, and each guide link assembly 13 includes a front end coupling with the first pivot 101 and a rear end coupling with one corresponding pedal 14. In addition, each crank 12 includes a second end coupling with one corresponding guide link assembly 13. Each flexible member 15 includes a front end to indirectly couple with the first pivot 10 and a rear end to couple with one corresponding guide link assembly 13.

Referring to FIGS. 1-5, each flexible member 15 can be a plastic or leather belt, a metal rope or wire, or other flexible members made of a material with flexibility.

Referring to FIGS. 1-5, each flexible member 15 may include a front end coupling a first end of a joint member 16, and a second end of the joint member 16 is pivotally connected to the first pivot 101.

Referring to FIGS. 1-5, the elliptical trainer 1 may further include a hollow support tube 17, which is fixed with the frame 10. The hollow support tube 17 may contain one or more, e.g., two rollers 171. The flexible member 17 is guided by the rollers 171 and passes through the hollow support tube 17 and then couples with one corresponding guide link assembly 13.

Referring to FIGS. 1-5, the hollow support tube 17 may be U-shaped, and the flexible members 17 are hanged from the two terminals of the U-shaped hollow support tube 17. In other embodiments, the hollow support tube 17 may have a different shape.

Referring to FIGS. 1-5, each guide link assembly 13 may include an upper linking member 131, a crank linking member 132, and a foot-support member 133. Each of them includes a first end and a second end. The first end of the upper linking member 131 is pivoted to the first pivot 101, the second end of the upper linking member 131 pivotally connects with the first end of the crank linking member 132, the second end of the crank linking member 132 pivotally connects with the first end of the foot-support member 133, and the second end of the foot-support member 133 connects with one corresponding pedal 14. In addition, the second end of crank 12 is fixed with a portion between the first end and second end of the crank linking member 132.

Referring to FIGS. 1-5, each foot-support member 133 may include a lateral rod 1331 protruded from its outer side, and the flexible member 15 connects with the lateral rod 1331.

Referring to FIGS. 1-5, each guide link assembly 13 makes the connected pedal 14 an approximately horizontal movement, and the corresponding flexible member 15 makes the pedal 14 an approximately vertical movement, and the approximately horizontal movement combined with vertical movement will lead to an elliptical or elliptical-like moving path for the pedal 14.

Referring to FIGS. 1-5, the elliptical trainer 1 may further include two hand assemblies 18 disposed at a left side and a right side of the frame 10. A front end of each hand assembly 18 includes a handle 181 to be grasped by the operator, and a rear end of each hand assembly 18 pivotally connects with the first end of the joint member 16.

Referring to FIGS. 1-5, each hand assembly 18 may further include a first linking arm 182 and a second linking arm 183. Each of the handle 181, the first linking arm 182, and the second linking arm 183 includes a first end and a second end. The first end of the handle 181 is held by the operator, and the second end of the handle 181 is pivoted to a second pivot 104 of the frame 10. The first end of the first linking arm 182 is pivoted to the second pivot 104, the second end of the first linking arm 182 pivotally connects with the first end of the second linking arm 183, and the second end of the second linking arm 183 pivotally connects with the joint member 16.

Referring to FIGS. 1-5, when the operator stands on the pedals 14 with his or her feet moving along elliptical path, the resistance device 11 provides a resistance to the operator. A control interface (not shown) may be used to adjust the resistance. Conventional elliptical trainer employs wheels and tracks to form an elliptical moving path, and a lot of linking mechanisms are needed. The conventional design has drawbacks of noise and unsmooth rolling and derailing of wheels. By contrast, this invention provides elliptical trainers with advantages of small volume, simple structure, smooth operation, and low noise. The excellent design of this invention can save huge material cost and prompts training effect for the operators.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An elliptical trainer, comprising:

a frame comprising a first pivot;

a resistance device being mounted on the frame and having a wheel with an axis for providing a resistance;

two cranks respectively arranged at a left side and a right side of the wheel, a first end of each crank being coupled with the axis of the wheel;

two guide link assemblies respectively arranged at a left side and a right side of the frame, a front end of each guide link assembly being pivoted to the first pivot, a rear end of each guide link assembly being coupled with a pedal, a second end of each crank being directly coupled with one corresponding guide link assembly; and two flexible members, a front end of each flexible member being indirectly pivoted to the first pivot and a rear end of each flexible member being coupled with one corresponding guide link assembly;

wherein the front end of each flexible member connects with a first end of a joint member, and a second end of the joint member is directly pivoted to the first pivot.

2. The elliptical trainer as recited in claim 1, wherein each flexible member comprises a plastic belt, a leather belt, a metal rope, or a wire rope.

3. The elliptical trainer as recited in claim 1, wherein each guide link assembly is configured to enable an approximately horizontal movement of the corresponding pedal, the corresponding flexible member is configured to enable an approximately vertical movement of the corresponding pedal, and the approximately horizontal movement combined with the approximately vertical movement leads to an elliptical or generally elliptical moving path.

4. The elliptical trainer as recited in claim 1, further comprising a hollow support tube fixed with the frame, wherein one or more rollers are disposed within the hollow support tube, each flexible member is guided by the one or more rollers and passes through the hollow support tube and then couples with one corresponding guide link assembly.

5. The elliptical trainer as recited in claim 4, further comprising two hand assemblies, wherein a front end of each hand assembly includes a handle configured to be held by a user, and a rear end of each hand assembly couples to the joint member.

6. The elliptical trainer as recited in claim 5, wherein each hand assembly further comprises a first linking arm and a second linking arm, and wherein a first end of the handle is configured to be held by the user, a second end of the handle is pivoted to a second pivot, a first end of the first linking arm is pivoted to the second pivot, a second end of the first linking arm pivotally connects with a first end of the second linking arm, and a second end of the second linking arm pivotally connects with the joint member.

7. The elliptical trainer as recited in claim 1, wherein each guide link assembly comprises an upper linking member, a crank linking member, and a foot-support member, and wherein a first end of the upper linking member is pivoted to the first pivot, a second end of the upper linking member pivotally connects with a first end of the crank linking member, a second end of the crank linking member pivotally connects with a first end of the foot-support member, a second end of the foot-support member connects with one corresponding pedal, and a second end of one corresponding crank is fixed with a portion of the crank linking member between the first end and the second end of the crank linking member.

8. The elliptical trainer as recited in claim 7, wherein a lateral rod is disposed between the first end and the second end of each foot-support member, and one corresponding flexible member couples with the lateral rod.

9. The elliptical trainer as recited in claim 1, wherein the resistance device further comprises a pulley and a flywheel, and wherein the wheel connects with the pulley via a first connecting member, and the pulley connects with the flywheel via a belt or a chain.

* * * * *